US005598687A

United States Patent [19]

Hester

[11] Patent Number: 5,598,687

[45] Date of Patent: Feb. 4, 1997

[54] STIRRUP SWIVEL ATTACHMENT

[76] Inventor: Daniel L. Hester, 15790 SE. 29th St., Choctaw, Okla. 73020

[21] Appl. No.: 464,549

[22] Filed: Jun. 5, 1995

[51] Int. Cl.[6] ..... B68C 3/00

[52] U.S. Cl. ..... 54/47

[58] Field of Search ..... 54/47, 48, 49, 54/49.5

[56] References Cited

U.S. PATENT DOCUMENTS

| | | | |
|---|---|---|---|
| 169,209 | 10/1875 | Wagstaff . | |
| 321,984 | 7/1885 | Laughlin . | |
| 608,605 | 8/1898 | House | 54/49 X |
| 1,174,712 | 3/1916 | Gunn | 54/47 |
| 2,532,082 | 11/1950 | Borst | 54/47 |
| 3,423,904 | 1/1969 | Stubblefield | 54/49 |
| 3,927,509 | 12/1975 | Riebold | 54/48 |

*Primary Examiner*—Robert P. Swiatek
*Attorney, Agent, or Firm*—Bill D. McCarthy; Phillip L. Free, Jr.; Randall K. McCarthy

[57] ABSTRACT

A stirrup swivel attachment which includes a stop for stopping the pivotation of the stirrup so that the stirrup pivots freely only within a limited range. The stirrup swivel attachment includes a first horizontal web portion having a midpoint and a longitudinal axis; a horizontal u-shaped member having a second horizontal web portion with a midpoint, a longitudinal axis and two ends, and having flange portions that extend vertically upward from the ends of the second horizontal web portion; a pin for pivotally connecting the first and second horizontal web portions at the midpoints thereof; and a stop disposed on the first horizontal web portion at a point removed from the midpoint thereof for stopping the second horizontal web portion when the first horizontal web portion is pivoted about the pin so that the longitudinal axes of the first and second horizontal web portions cannot become vertically aligned. The stop is disposed on the first horizontal web portion at a selected position which allows less than 180 degree pivotation of the first horizontal web portion with respect to the second horizontal web portion. In preferred embodiments the stop includes a boss rigidly attached to the first horizontal web portion.

25 Claims, 2 Drawing Sheets

STIRRUP SWIVEL ATTACHMENT

BACKGROUND OF INVENTION

1. Field of the Invention

The present invention relates to stirrups, and more particularly but not by way of limitation, to an improved stirrup swivel attachment which includes a stop means for stopping the pivotation of the stirrup so that the stirrup pivots freely only within a limited range.

2. Discussion

Horses were long ridden bareback or with simple cloths or blankets. However, the development of the leather saddle in the Far East in the period from the 3rd century BC to the 1st century AD greatly improved the horse's potential, by making it easier for a rider to keep his seat. The invention of the stirrup in about the 2nd century BC was an integral part of this development, serving as a support for the rider's foot in riding and as an aid in mounting.

The saddle received a high degree of development in medieval Europe, especially in France, as an indispensable element in the knightly shock combat of the feudal age. The modern stirrup and its attachment to the saddle differs only in detail from those of the Middle Ages. The stirrup is fastened to the stirrup leather of the saddle by a bolt or axis which is pushed through the stirrup leather loop and tightened by means of a nut. Fastened to the saddle in this manner, the natural tendency of the stirrup is to hang in the outward direction, i.e. perpendicular to the body of the horse and in a position which would make it impossible for the rider to place a foot in each stirrup on either side of the horse in parallel position.

To have the stirrup hanging in the proper riding position, that is, parallel to the body of the horse, it has traditionally been necessary to twist the stirrup leather by means of soaking the leather in soap and water and shaping the leather into position. This is a very labor intensive and time consuming process, especially for the inexperienced horseman. In spite of this twisting and shaping of the stirrup leather, the stirrup leather often retains at least some of its natural tendency to turn outward. The outward twisting of the stirrup can create ankle and knee strain on the rider, an obviously undesirable effect.

When the stirrup leather is properly trained, the stirrup hangs in the proper position for riding. Unfortunately, though, this is not the most convenient position for mounting the horse. In the proper position for riding, the stirrup faces toward the rear of the horse. This causes difficulty for the rider in placing his foot into the stirrup when standing alongside the horse while trying to maintain control of the reins.

Several patents have attempted to resolve the above noted problems with the traditional stirrup and its attachment to the stirrup leather, but none has received widespread acceptance. U.S. Pat. No. 321,984 issued to Laughlin in 1885, U.S. Pat. No. 396,179 issued to Taylor in 1889, U.S. Pat. No. 1,174,712 issued to Gunn in 1916 and U.S. Pat. No. 2,532,082 issued to Borst in 1950 disclose swiveling stirrups, each of which dispenses with the necessity of twisting the stirrup leather, overcome the problem of knee strain and allows the stirrup to be pivoted outward to accommodate placement of the rider's foot during mounting. However, each of the stirrups disclosed therein allows 360 degree pivotation of the stirrup, permitting the stirrup to pivot toward the head of the horse during mounting, which is not only undesirable, but dangerous as well. Thus, none of these stirrups provides a stable platform for the rider during mounting. In addition, the free pivotation of the stirrup allows the stirrup to assume a position which is parallel to the body of the horse, making it difficult for the rider to position his right foot in the stirrup once mounted.

U.S. Pat. No. 169,209 issued to Wagstaff in 1875 also discloses a stirrup which can be used without the necessity of twisting the stirrup leather. The invention disclosed therein has a detent spring attached to the top of the stirrup iron which engages a shoulder on the upper portion of the stirrup attachment. The metal on the stirrup iron is cut away underneath the detent spring so that it may be depressed, releasing it from the shoulder and allowing it to pivot outwardly to facilitate placement of the rider's foot during mounting. However, during mounting no part of the stirrup attachment prevents the stirrup from rotating toward the head of the horse as described above. Furthermore, if rotated toward the head of the horse, the detent spring will again engage the shoulder and lock the stirrup into this position, perhaps causing even greater problems for the rider.

In the proper riding position the detent springs on the stirrup attachments lock the stirrups into position, apparently allowing little or no pivotation of the stirrups. The relative rigidity of this arrangement could cause ankle or knee strain on the rider, in spite of the fact that the stirrup leather does not need to be twisted. In addition to the above stated problems, the invention disclosed therein is of questionable durability given the rugged nature of the intended use. For example, dirt could build up in the space below detent spring, preventing the rotation of the stirrup to the mounting position.

U.S. Pat. No. 608,605 issued to House in 1898 discloses a stirrup that allows limited pivotation to permit the rider to mount wild, broken or kicking horses. The rider stands near the head of the horse and faces toward the rear, places his near foot in the stirrup and vaults into the saddle, pivoting the stirrup into the proper riding position. However, because of the limited range of pivotation, the stirrup disclosed therein does not dispense of the necessity to twist the stirrup leather. Furthermore, if used to mount a tame horse in a conventional manner, the stirrup could permit the rider to pivot toward the head of the horse as described above, an obvious safety hazard. The invention disclosed therein is also of questionable durability given that the invention utilizes a relatively small pin which rides in a narrow, circular recess.

While various swiveling stirrups exist, there remains a need for a swivel stirrup attachment which reduces ankle and knee strain, allows easy but safe mounting, is inexpensive to manufacture, yet durable in construction, and which overcomes the various deficiencies of the prior art.

SUMMARY OF THE INVENTION

The present invention provides a stirrup swivel attachment which includes a first horizontal web portion; a horizontal u-shaped member having a second horizontal web portion, and having flange portions that extend vertically upward from the ends of the second horizontal web portion; a pivot means for pivotally connecting the first and second horizontal web portions at the midpoints thereof; and a stop means disposed on the first horizontal web portion at a point removed from the midpoint thereof for stopping the second horizontal web portion when the first horizontal web portion is pivoted about the pivot means so that the longitudinal axes of the first and second horizontal web portions cannot become vertically aligned.

The stop means is disposed on the first horizontal web portion at a selected position which allows less than 180 degree rotation of the first horizontal web portion with respect to the second horizontal web portion. In preferred embodiments the stop means includes a boss rigidly attached to the first horizontal web portion.

An object of the present invention is to provide a stirrup swivel attachment which allows free pivotation over a limited range in either direction when the stirrup is in the riding position, i.e., perpendicular to the body of the horse, to reduce ankle and knee strain on the rider.

Another object of the present invention, while achieving the above stated object, is to provide a stirrup swivel attachment which allows the stirrup to be pivoted outwardly during mounting to facilitate placement of the rider's foot in the stirrup, yet does not allow the rider to pivot toward the horse's head during mounting.

Still another object of the present invention, while achieving the above stated objects, is to provide a stirrup swivel attachment which prohibits pivotation of the stirrup to a position parallel with the horse's body, reducing the likelihood that the rider will encounter difficulty in placing his foot in the stirrup.

Yet another object of the present invention, while achieving the above stated objects, is to provide a stirrup swivel attachment which is inexpensive to manufacture, yet durable in construction, and which overcomes the various deficiencies of the prior art.

Other objects, advantages and features of the present invention will become apparent from a reading of the following description taken in conjunction with the accompanying drawing and appended claims.

DESCRIPTION

Figure 1:
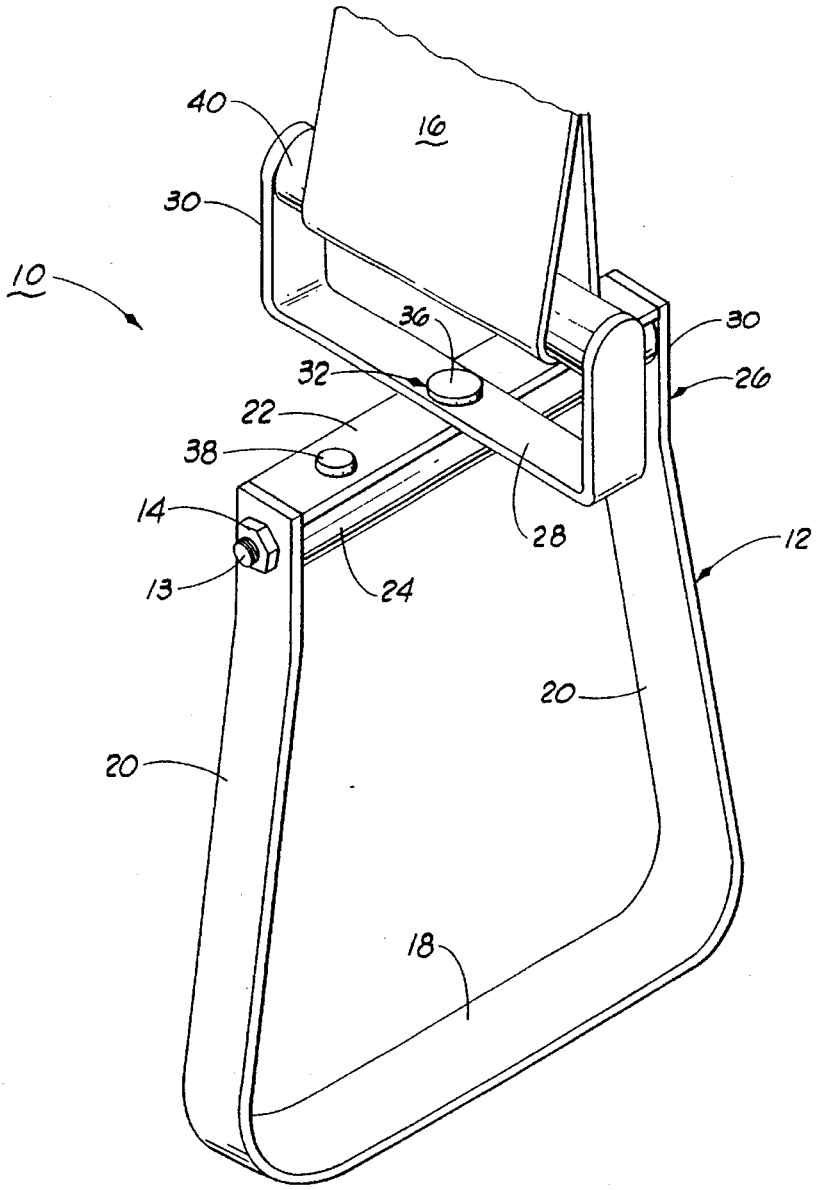
FIG. 1 is a perspective view of a stirrup swivel attachment according to the present invention depicted with the stirrup attached and shown mounted in a stirrup leather loop on the left (mounting) side of a saddle.

Referring to FIG. 1 of the drawings, shown therein is a stirrup swivel attachment 10 constructed in accordance with the present invention. The stirrup swivel attachment 10 is depicted attached to a stirrup 12 by a bolt 13 and nut 14 and attached to the stirrup leather 16 of a saddle (not shown). The stirrup 12 shown is of a conventional type, having a horizontal stirrup body portion 18 and two upwardly converging stirrup side portions 20, each of which terminates at a distal end. Although FIG. 1 depicts the stirrup swivel attachment 10 and stirrup 12 attached to the stirrup leather 16 on the left (mounting) side of the horse, it should be understood that a stirrup swivel attachment 10 and stirrup 12 are attached in identical fashion to the stirrup leather 16 on the right side of the horse as well.

The stirrup swivel attachment 10 has a first horizontal web portion 22 attached above a first horizontal tubular member 24 which is interposed between the distal ends of the stirrup side portions 20. The stirrup 12 is attached to the stirrup swivel attachment 10 by passing the bolt 13 through the distal ends of the stirrup side portions 20 and through the first horizontal tubular member 24 and securing the bolt 13 with the nut 14.

Figure 2:
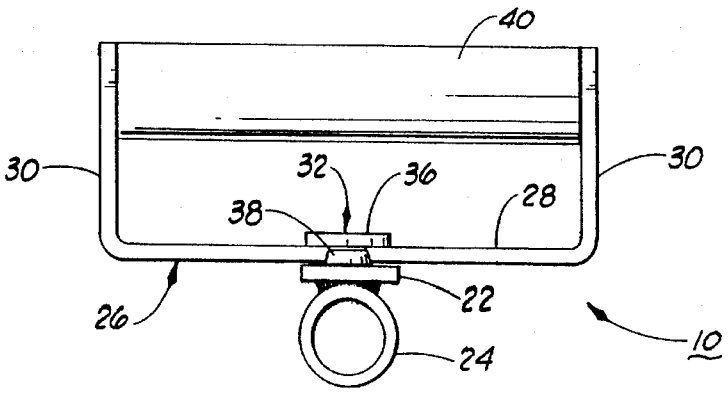
FIG. 2 is a side elevational view of a stirrup swivel attachment according to the present invention shown in the riding position, i.e., with the lower section perpendicular to the horse's body.
Figure 3:
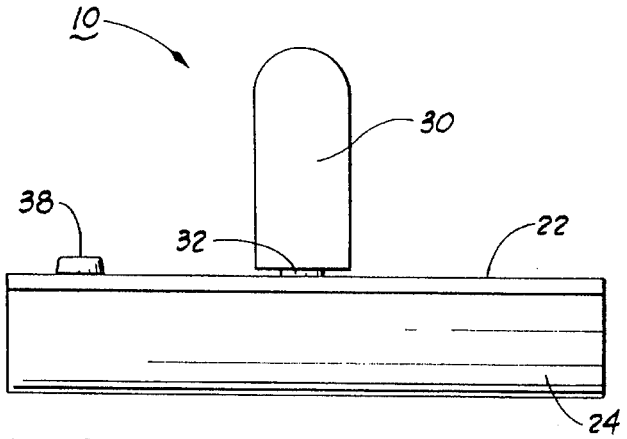
FIG. 3 is an end elevational view of a stirrup swivel attachment according to the present invention shown in the riding position.

As shown in FIG. 2, a horizontal u-shaped member 26 having a second horizontal web portion 28 and having flange portions 30 that extend vertically upward from the ends of the second horizontal web portion 28 is disposed above and pivotally attached to the first horizontal web portion 22. As depicted in FIGS. 2 and 3, the first and second horizontal web portions 22, 28 are connected at the midpoints thereof by a pin 32. The pin 32 is rigidly attached at one end to the first horizontal web portion 22, passes through a hole (not shown) in the second horizontal web portion 28 and has a head 36 at the other end. Although the presently described means (referred to herein as a "pivot means") for pivotally attaching the first and second horizontal web portions 22, 28 includes a pin 32, persons skilled in the art will recognize various other pivot means which could be used consistent with the present invention, all of which are included within the spirit and scope of the present invention.

Figure 4:
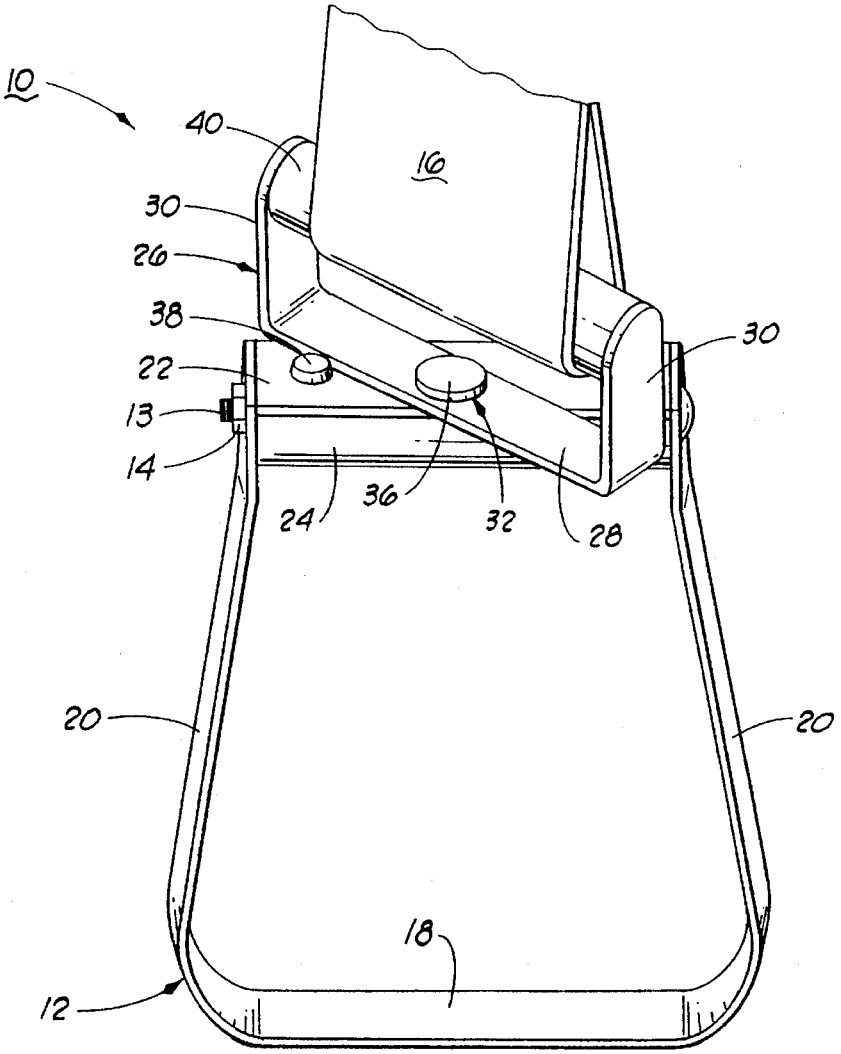
FIG. 4 is a perspective view of a stirrup swivel attachment according to the present invention depicted with the stirrup attached and shown mounted in the stirrup leather loop on the left (mounting) side of the saddle. The stirrup shown therein is shown in the mounting position, with the stirrup pivoted outwardly.

Turning now to FIGS. 3 and 4, the stirrup swivel attachment 10 of the present invention also includes a means (referred to herein as a "stop means") for stopping the first horizontal web portion 22 when it is pivoted about the pivot means so that the longitudinal axes of the first and second horizontal web portions 22, 28 cannot become vertically aligned. The stop means allows the first horizontal web portion 22 less than 180 degrees of pivotation with respect to the second horizontal web portion 28. In the presently depicted embodiment, the stop means is a boss 38, a protuberant body, rigidly attached to the first horizontal web portion 22 which engages the second horizontal web portion 28 during pivotation, thus stopping the pivotation so that the first and second horizontal web portions 22, 28 cannot become vertically aligned.

Persons skilled in the art will recognize that various other stop means could be used consistent with the present invention, all of which are within the scope of the present invention. For example, in an alternative embodiment, the stop means can be a boss (not shown) attached to the second horizontal web portion 28 which engages the first horizontal web portion 22 during pivotation, thereby stopping the pivotation so that the first and second horizontal web portions 22, 28 cannot become vertically aligned. In other alternative embodiments the boss 38 may be removable, rather than rigidly mounted.

A second horizontal tubular member 40 is interposed between the flange portions 30 of the horizontal u-shaped member 26 and is preferably rigidly attached thereto. The stirrup leather 16 passes around the second horizontal tubular member 40 and connects the stirrup swivel attachment 10 of the present invention to the saddle in the usual manner.

In the operation of the present invention, the rider stands facing the side of the horse with the reins grasped firmly in his left hand. If necessary, the rider uses his right hand to pivot the stirrup swivel attachment 10 so that the stirrup 12 faces more outwardly, thereby facilitating placement of the rider's foot in the stirrup 12. As shown in FIG. 4, the boss 38 serves as a stop to prevent the stirrup swivel attachment 10 from pivoting toward the horse's head, thereby providing a stable platform for the rider during mounting of the horse. The rider grasps the saddle horn with his right hand, places his left foot into the stirrup 12 and vaults into the saddle in the usual manner. The stirrup swivel attachment 10 allows the stirrup 12 and the rider's left foot to pivot into the proper riding position.

Once seated upon the saddle, the rider places his right foot in the stirrup 12 that hangs on the right side of the horse. The boss 38 prevents the stirrup swivel attachment 10 from pivoting the stirrup 12 to a position wherein the stirrup 12 is parallel with the horse. Thus, the stirrup 12 always hangs at an angle to the horse's body, making it easier for the rider to place his foot in the stirrup 12.

While riding, the stirrup swivel attachment 10 allows free pivotation of the stirrup 12 in either clockwise or counterclockwise direction over the limited range of pivotation allowed by the boss 38. The pivotation during riding reduces strain upon the knees and ankles of the rider which can lead to soreness.

In dismounting the stirrup swivel attachment 10 allows pivotation of the stirrup 12 outward, but only within the range allowed by the boss 38. The swivel stirrup attachment 10 allows the rider to pivot the stirrup 12 and his foot to a proper position for dismounting, yet provides a stable platform as well.

It is clear that the present invention is well adapted to carry out the objects and to attain the ends and advantages mentioned as well as those inherent therein. While presently preferred embodiments have been described for purposes of this disclosure, numerous changes may be made which will readily suggest themselves to those skilled in the art and which are encompassed within the spirit of the invention disclosed and as defined in the appended claims.

What is claimed is:

1. A stirrup swivel attachment comprising:

a first horizontal web portion having a midpoint and a longitudinal axis;

a horizontal u-shaped member having a second horizontal web portion with a midpoint, a longitudinal axis and two ends, and having flange portions that extend vertically upward from the ends of the second horizontal web portion;

a pivot means for pivotally connecting the first and second horizontal web portions at the midpoints thereof; and a stop means disposed on the first horizontal web portion at a point removed from the midpoint thereof for stopping the second horizontal web portion when the first horizontal web portion is pivoted about the pivot means so that the longitudinal axes of the first and second horizontal web portions cannot become vertically aligned.

2. The stirrup swivel attachment of claim 1 wherein the stop means is disposed on the first horizontal web portion at a selected position which allows less than 180 degree pivotation of the first horizontal web portion with respect to the second horizontal web portion.

3. The stirrup swivel attachment of claim 2 wherein the stop means comprises:

a boss rigidly attached to the first horizontal web portion.

4. The stirrup swivel attachment of claim 3 further comprising:

a first horizontal tubular member disposed below the first horizontal web portion and attached thereto.

5. The stirrup swivel attachment of claim 4 further comprising:

a second horizontal tubular member disposed between the flange portions of the horizontal u-shaped member.

6. The stirrup swivel attachment of claim 2 wherein the stop means comprises:

a pin removably mounted on the first horizontal web portion.

7. The stirrup swivel attachment of claim 1 further comprising:

a first horizontal tubular member disposed below the first horizontal web portion and attached thereto.

8. The stirrup swivel attachment of claim 7 further comprising:

a second horizontal tubular member disposed between the flange portions of the horizontal u-shaped member.

9. A stirrup swivel attachment comprising:

a first horizontal web portion having a midpoint and a longitudinal axis;

a horizontal u-shaped member having a second horizontal web portion with a midpoint, a longitudinal axis and two ends, and having flange portions that extend vertically upward from the ends of the second horizontal web portion;

a pivot means for pivotally connecting the first and second horizontal web portions at the midpoints thereof; and a stop means disposed on the second horizontal web portion at a point removed from the midpoint thereof for stopping the first horizontal web portion when the first horizontal web portion is pivoted about the pivot means so that the longitudinal axes of the first and second horizontal web portions cannot become vertically aligned.

10. The stirrup swivel attachment of claim 9 wherein the stop means is disposed on the second horizontal web portion at a selected position which allows less than 180 degree pivotation of the first horizontal web portion with respect to the second horizontal web portion.

11. The stirrup swivel attachment of claim 10 wherein the stop means comprises:

a boss rigidly attached to the second horizontal web portion.

12. The stirrup swivel attachment of claim 11 further comprising:

a first horizontal tubular member disposed below the first horizontal web portion and attached thereto.

13. The stirrup swivel attachment of claim 12 further comprising:

a second horizontal tubular member disposed between the flange portions of the horizontal u-shaped member.

14. The stirrup swivel attachment of claim 10 wherein the stop means comprises:

a pin removably mounted on the second horizontal web portion.

15. The stirrup swivel attachment of claim 14 further comprising:

a first horizontal tubular member disposed below the first horizontal web portion and attached thereto.

16. The stirrup swivel attachment of claim 15 further comprising:

a second horizontal tubular member disposed between the flange portions of the horizontal u-shaped member.

17. A stirrup comprising:

a horizontal stirrup body portion having two ends;

two upwardly converging stirrup side portions attached to the ends of the stirrup body portion, each stirrup side portion terminating in a distal end;

a first horizontal tubular member disposed between the distal ends of the stirrup side portions;

a first horizontal web portion disposed above the first horizontal tubular member and attached thereto;

a horizontal u-shaped member having a second horizontal web portion with a midpoint, a longitudinal axis and two ends, and having flange portions that extend vertically upward from the ends of the second horizontal web portion;

a pivot means for pivotally connecting the first and second horizontal web portions at the midpoints thereof; and stop means for stopping the first horizontal web portion when the first horizontal web portion is pivoted about the pivot means so that the longitudinal axes of the first and second horizontal web portions cannot become vertically aligned.

18. The stirrup of claim 17 wherein the stop means is disposed on the first horizontal web portion at a point removed from the midpoint thereof.

19. The stirrup of claim 18 wherein the stop means comprises:

a boss rigidly attached to the first horizontal web portion.

20. The stirrup of claim 19 further comprising:

a second horizontal tubular member disposed between the flange portions of the horizontal u-shaped member.

21. The stirrup of claim 18 wherein the stop means comprises:

a pin removably attached to the first horizontal web portion.

22. The stirrup of claim 17 wherein the stop means is disposed on the first horizontal web portion at a point removed from the midpoint thereof.

23. The stirrup of claim 22 wherein the stop means comprises:

a boss rigidly attached to the first horizontal web portion.

24. The stirrup of claim 23 further comprising:

a second horizontal tubular member disposed between the flange portions of the horizontal u-shaped member.

25. The stirrup of claim 22 wherein the stop means comprises:

a pin removably attached to the first horizontal web portion.

* * * * *